US007624608B1

(12) United States Patent
Karty

(10) Patent No.: US 7,624,608 B1
(45) Date of Patent: Dec. 1, 2009

(54) REBAR BENDING DEVICE

(76) Inventor: Marcus Karty, 3183 Elmore St., Simi Valley, CA (US) 93063

( * ) Notice: Subject to any disclaimer, the term of this patent is extended or adjusted under 35 U.S.C. 154(b) by 0 days.

(21) Appl. No.: 12/366,631

(22) Filed: Feb. 5, 2009

(51) Int. Cl.
*B21J 13/08* (2006.01)
*B21D 7/024* (2006.01)

(52) U.S. Cl. ..... 72/31.05; 72/218; 72/388; 72/458; 72/479; 81/177.1; 81/177.7; 81/177.8; 140/106

(58) Field of Classification Search ..... 72/31.01, 72/31.04, 31.05, 149, 217, 218, 387, 388, 72/457, 458, 479; 140/102.5, 106; 81/177.1, 81/177.7, 177.8
See application file for complete search history.

(56) References Cited

U.S. PATENT DOCUMENTS 2,675,723 A * 4/1954 Stein ..... 72/458
3,732,721 A * 5/1973 Cusimano ..... 72/458
3,943,747 A 3/1976 Wesler et al.
4,009,602 A 3/1977 Linquist
4,304,117 A * 12/1981 Rawson ..... 72/388
4,798,078 A 1/1989 Schweitzer
D334,754 S 4/1993 Pearson et al.
5,669,258 A 9/1997 Luebke
D416,566 S 11/1999 Perez
6,128,944 A * 10/2000 Haynes ..... 72/458
6,418,773 B1 * 7/2002 Tolman ..... 72/458
6,497,133 B1 * 12/2002 Rose ..... 72/388
6,993,950 B2 2/2006 Bryan
6,997,030 B1 * 2/2006 Williams ..... 72/458

* cited by examiner

*Primary Examiner*—David B Jones

(57) ABSTRACT end; a first steel pin for pivotally connecting the rotator plate to the base plate, a handle disposed on the second end of the rotator plate; a second measurement plate fixedly attached to the first measurement plate and the rotator plate; a second steel pin disposed on the second measurement plate; a third steel pin disposed on the rotator plate; wherein the rebar can be positioned in between the first, second, and third steel pins; wherein a user can bend the rebar by rotating the rotator plate via the handle.

5 Claims, 6 Drawing Sheets

REBAR BENDING DEVICE

FIELD OF THE INVENTION

The present invention is directed to a device for bending metal bars, such as bars used to reinforce concrete (e.g., rebars). More particularly, the present invention is directed to a rebar bending device that is portable.

BACKGROUND OF THE INVENTION

The present invention features a rebar bending device for allowing a user to bend a bar used to reinforce concrete (e.g., a rebar). In some embodiments, the rebar bending device can be mounted on a tripod, mounted on a bed of a pickup truck, mounted on a trailer hitch, and/or mounted on similar devices.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
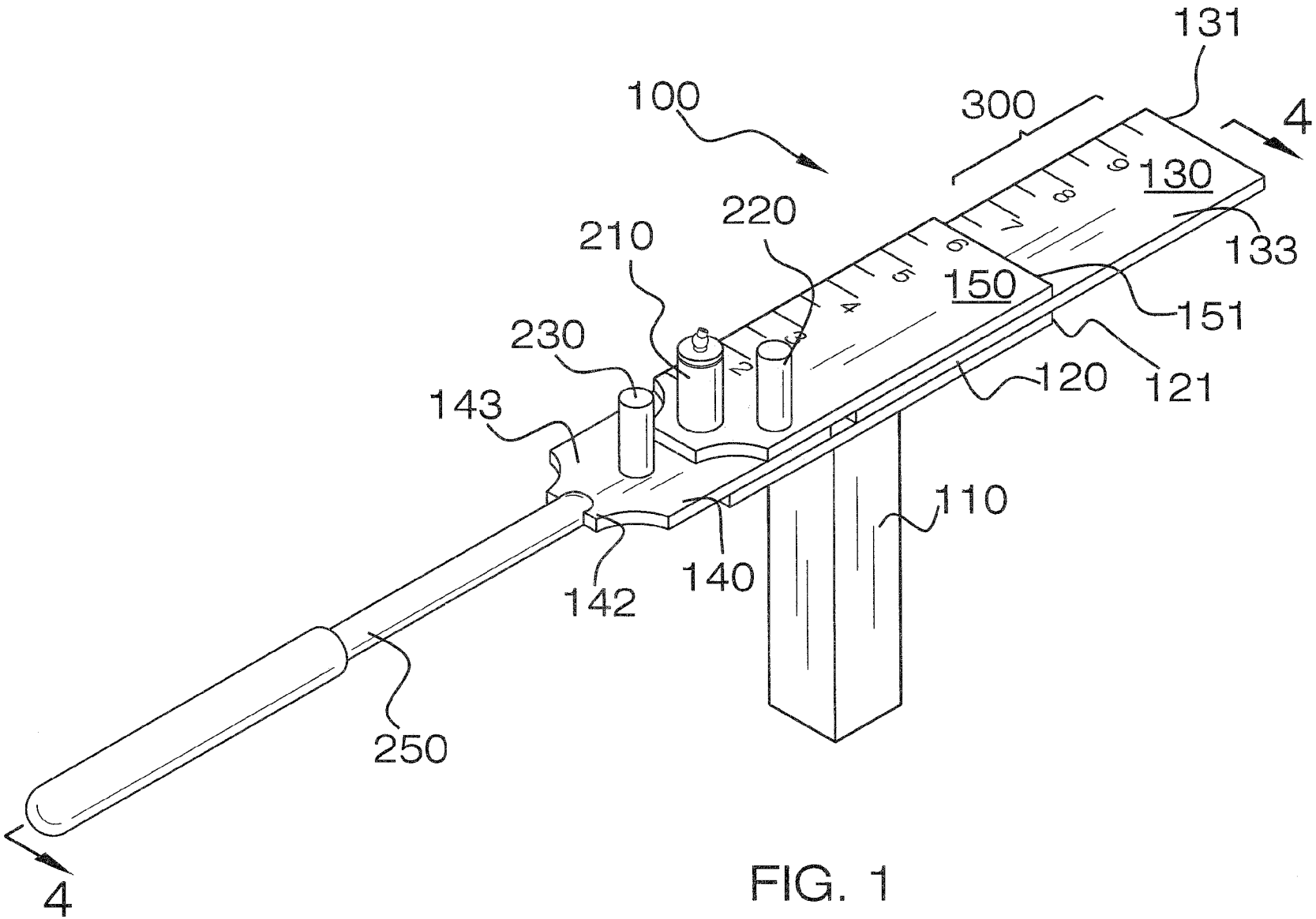
FIG. 1 is a perspective view of the rebar bending device of the present invention.
Figure 2:
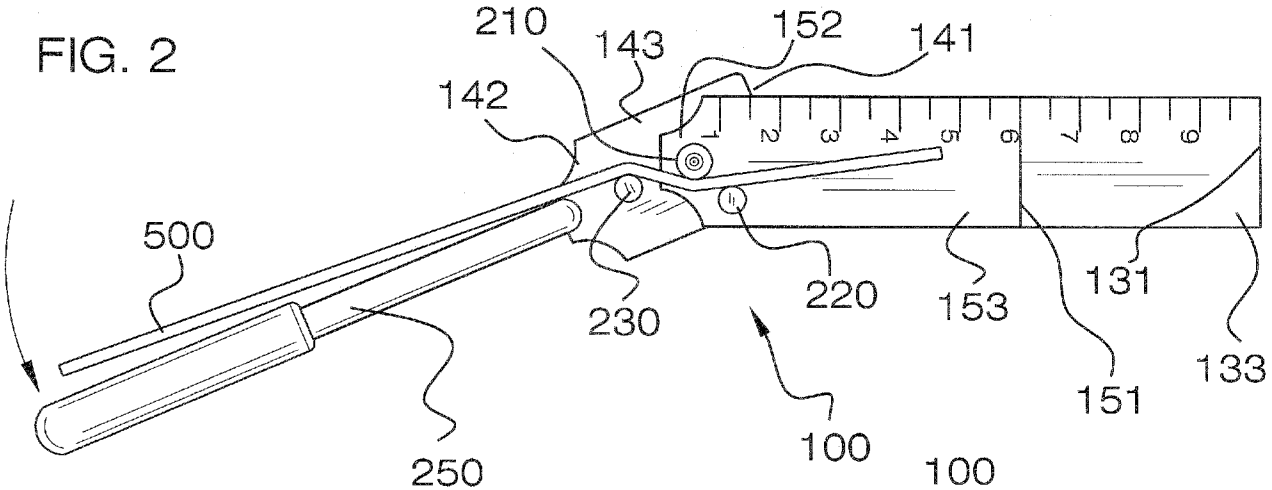
FIG. 2 is a top view of the rebar bending device of the present invention.
Figure 3:
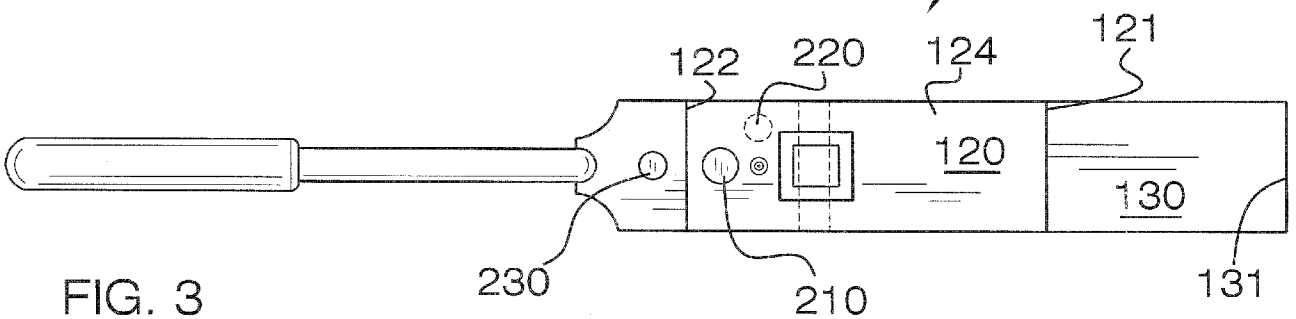
FIG. 3 is a bottom view of the rebar bending device of the present invention.
Figure 4:
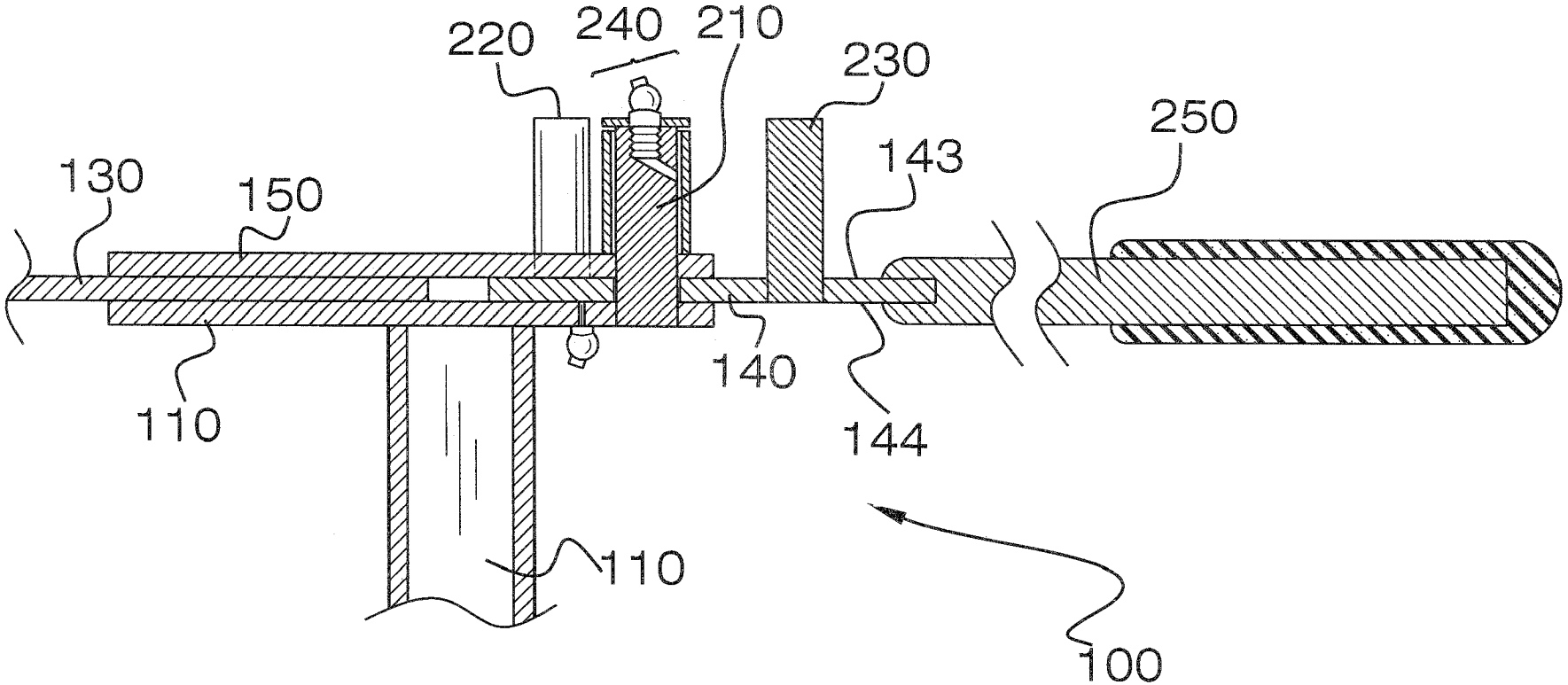
FIG. 4 is a side and cross sectional view of the rebar bending device of the present invention.
Figure 5:
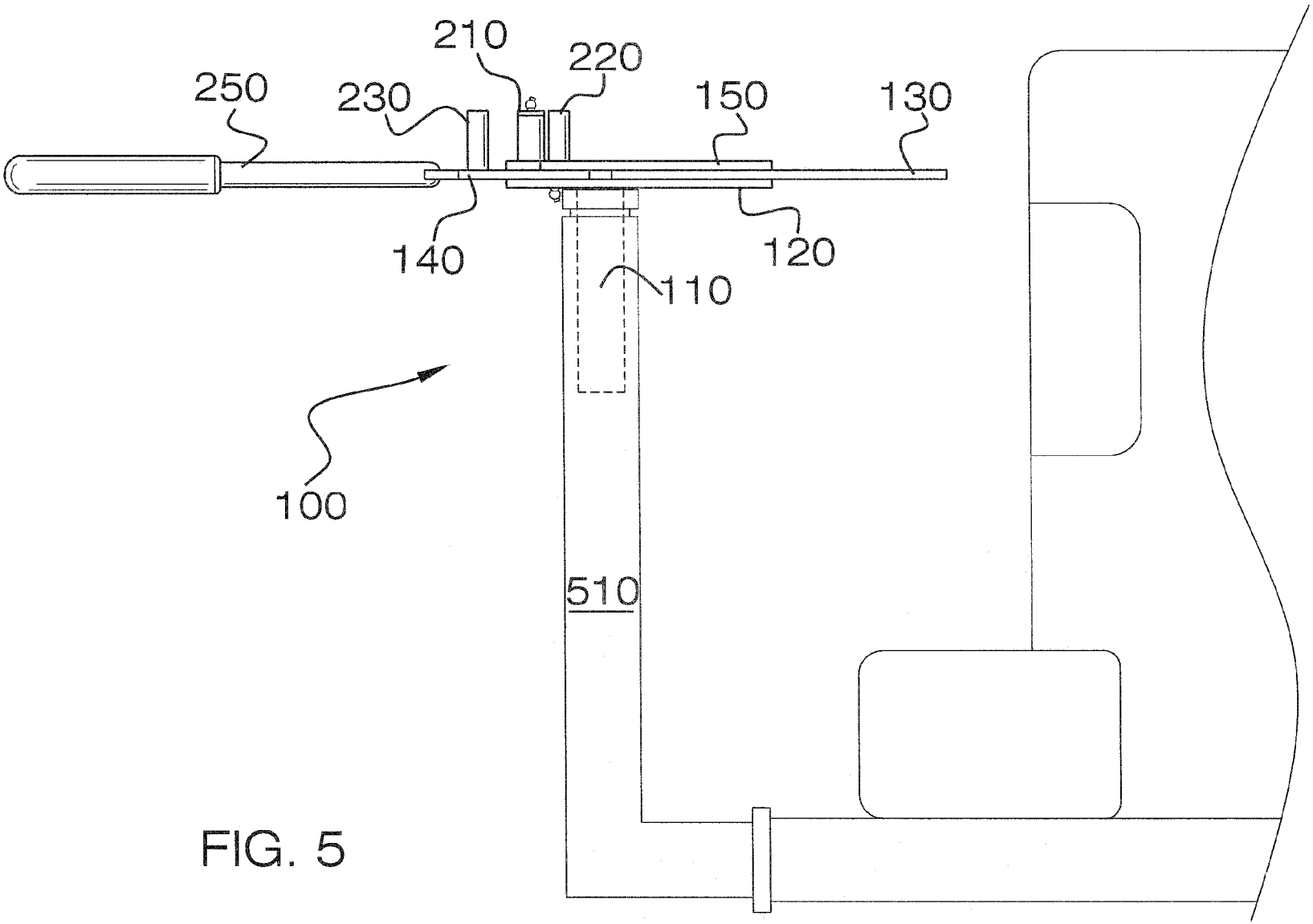
FIG. 5 is a side view of the rebar bending device of the present invention.
Figure 6:
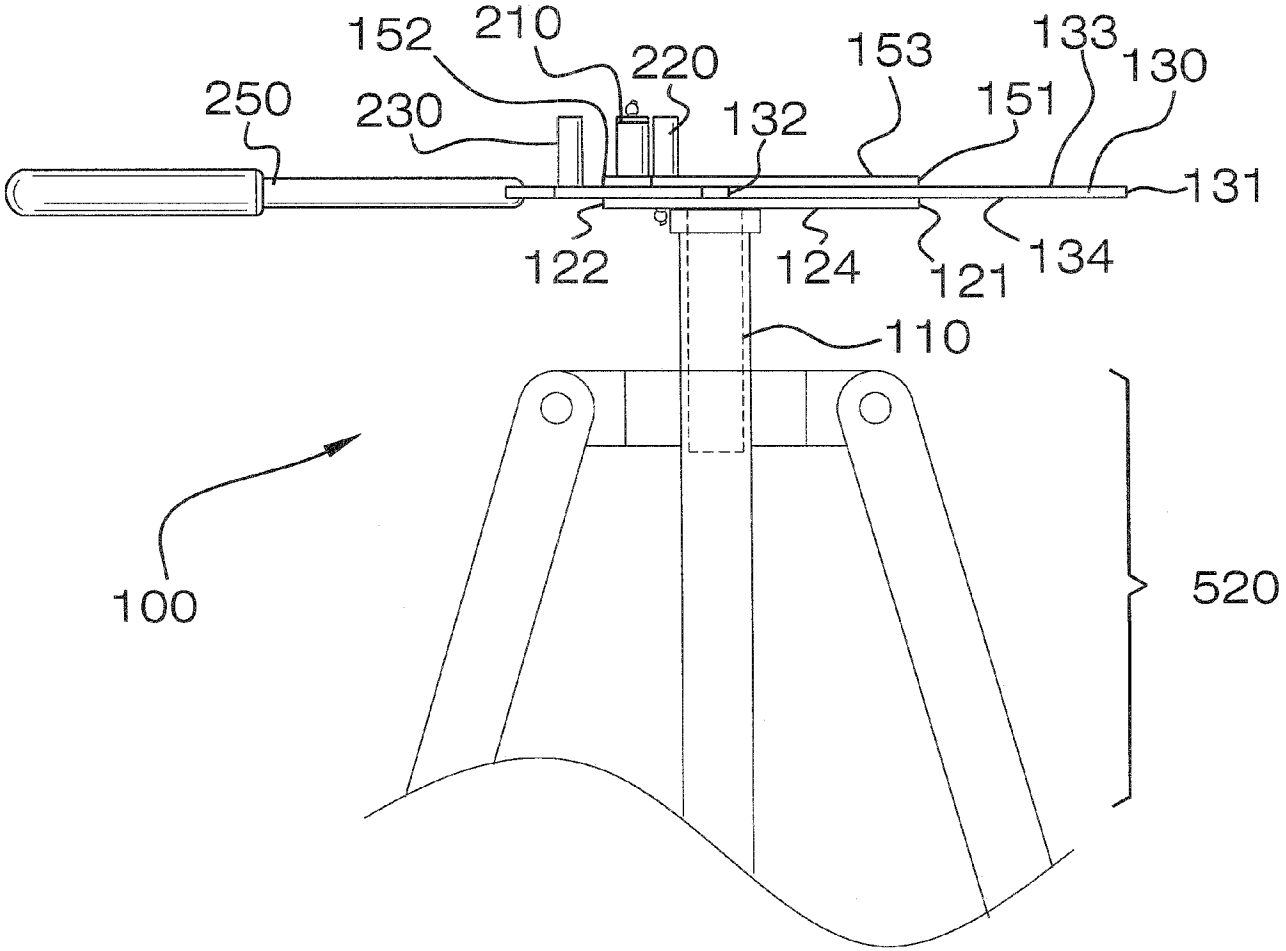
FIG. 6 is a side view of the rebar bending device of the present invention.

The following is a listing of numbers corresponding to a particular element refer to herein:

100 rebar bending device
110 support beam
120 base plate
121 first end of base plate
122 second end of base plate
123 top surface of base plate
124 bottom surface of base plate
130 first measurement plate
131 first end of first measurement plate
132 second end of first measurement plate
133 top surface of first measurement plate
134 bottom surface of first measurement plate
140 rotator plate
141 first end of rotator plate
142 second end of rotator plate
143 top surface of rotator plate
144 bottom surface of rotator plate
150 second measurement plate
151 first end of second measurement plate
152 second end of second measurement plate

153 top surface of second measurement plate
154 bottom surface of second measurement plate
210 first steel pin
220 second steel pin
230 third steel pin
240 grease fitting (e.g., zerk fitting)
250 handle
300 measurement markers
500 rebar
510 trailer hitch
520 tripod Referring now to FIGS. 1-6, the present invention features a rebar bending device 100 for allowing a user to bend a bar used to reinforce concrete (e.g., a rebar 500). In some embodiments, the rebar bending device 100 can be mounted on a tripod, mounted on a bed of a pickup truck, mounted on a trailer hitch 510, and/or mounted on similar devices.

The rebar bending device 100 comprises a base plate 120 having a top surface 123, a bottom surface 124, a first end 121, and a second end 122. A support beam 110 is attached to the bottom surface 124 of the base plate 120. The support beam 110 is for allowing the rebar bending device 100 to be mounted on a device such as a bed of a pickup truck, a tripod 520, a trailer hitch 510, or the like.

A first measurement plate 130 is attached to the top surface 123 of the base plate 120 near the first end 121, and a rotator plate 140 is attached to the top surface 123 of the base plate 120 near the second end 122. The first measurement plate 130 has a top surface 133, a bottom surface 134, a first end 131, and a second end 132. The rotator plate 140 has a top surface 143, a bottom surface 144, a first end 141, and a second end 142. The first measurement plate 130 is fixedly attached to the base plate 120. A first steel pin 210 pivotally connects the rotator plate 140 to the base plate 120, wherein the rotator plate 140 can pivot about the first steel pin 210 (see FIG. 2).

Disposed on the second end 142 of the rotator plate 140 is a handle 250. The handle 250 allows the user to easily rotate the rotator plate 140 about the first steel pin 210.

A second measurement plate 150 is attached to the top surface 133 of the first measurement plate 130 near the second end 132 of the first measurement plate 130 and attached to the top surface 143 of the rotator plate 140 near the first end 141 of the rotator plate 140. The second measurement plate 150 has a top surface 153, a bottom surface 154, a first end 151, and a second end 152. The first steel pin 210 connects the second measurement plate 150 to the rotator plate 140, and the first steel pin 210 extends through and above the second measurement plate 150. The second end 152 of the second measurement plate 150 is fixedly attached to the first measurement plate 130. The rotator plate 140 can rotate about the first steel pin 210 between the base plate 120 and the second measurement plate 150.

A second steel pin 220 is disposed on the top surface 153 of the second measurement plate 150 near the first steel pin 210. A third steel pin 230 is disposed on the top surface 143 of the rotator plate 140 near the second end 142. A piece of rebar 500 can be positioned in between the first steel pin 210, the second steel pin 220, and the third steel pin 230 (for example, see FIG. 2).

Figure 7:
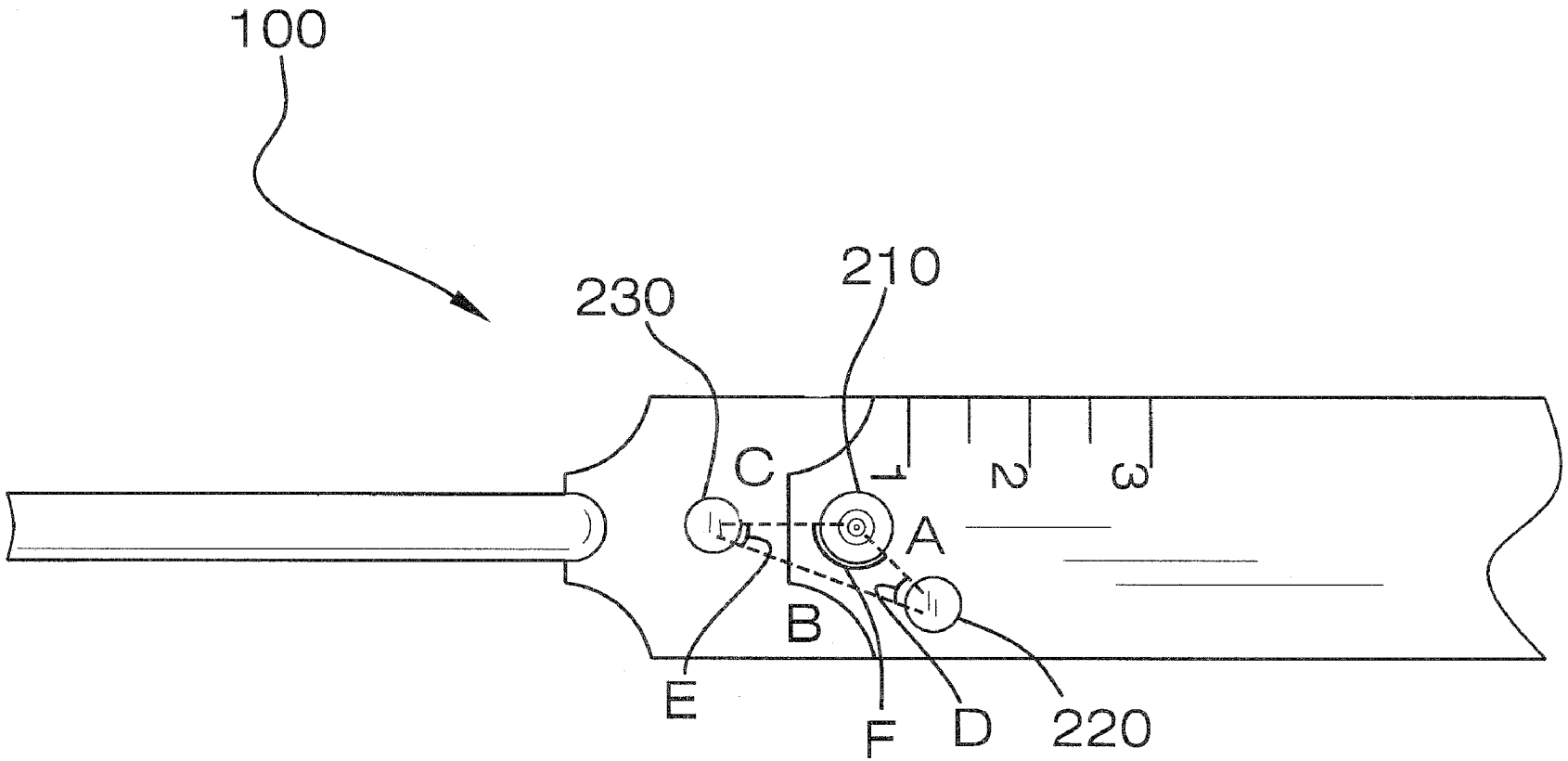
FIG. 7 is a top view of the rebar bending device of the present invention.

The first steel pin 210, the second steel pin 220, and the third steel pin 230 each have a center. As shown in FIG. 7, the distance between the center of the second steel pin 220 and the center of the third steel pin 230 is designated as distance B. The distance between the center of the first steel pin 210 and the center of the second steel pin 220 is designated as distance A. The distance between the center of the first steel pin 210 and the center of the third steel pin 230 is designated as distance C. The angle between distance A and distance B is angle D. The angle between distance B and distance C is angle E. The angle between distance A and distance C is angle F.

The rebar bending device 100 may be constructed in a variety of different sizes. In some embodiments, distance A is about 1.75 inches, distance B is about 3 inches, and distance C is about 1.75 inches. In some embodiments, angle D is about 31 degrees, angle E is about 31 degrees, and angle F is about 118 degrees.

In some embodiments, distance A is between about 1.0 to 1.25 inches. In some embodiments, distance A is between about 1.25 to 1.5 inches. In some embodiments, distance A is between about 1.5 to 1.75 inches. In some embodiments, distance A is between about 1.75 to 2.0 inches. In some embodiments, distance A is more than about 2.0 inches.

In some embodiments, distance B is between about 1.3 to 1.5 inches. In some embodiments, distance B is between about 1.5 to 2.0 inches. In some embodiments, distance B is between about 2.0 to 2.5 inches. In some embodiments, distance B is between about 2.5 to 3.0 inches. In some embodiments, distance B is between about 3.0 to 3.5 inches. In some embodiments, distance B is more than about 3.5 inches.

In some embodiments, distance C is between about 1.0 to 1.25 inches. In some embodiments, distance C is between about 1.25 to 11.5 inches. In some embodiments, distance C is between about 1.5 to 1.75 inches. In some embodiments, distance C is between about 1.75 to 2.0 inches. In some embodiments, distance C is more than about 2.0 inches.

In some embodiments, angle D is between about 15 to 25 degrees. In some embodiments, angle D is between about 25 to 35 degrees. In some embodiments, angle D is between about 35 to 45 degrees. In some embodiments, angle D is between about 45 to 55 degrees. In some embodiments, angle D is more than about 55 degrees.

In some embodiments, angle E is between about between about 15 to 25 degrees. In some embodiments, angle E is between about 25 to 35 degrees. In some embodiments, angle E is between about 35 to 45 degrees. In some embodiments, angle E is between about 45 to 55 degrees. In some embodiments, angle E is more than about 55 degrees.

In some embodiments, angle F is between about 25 to 35 degrees. In some embodiments, angle F is between about 35 to 45 degrees. In some embodiments, angle F is between about 45 to 55 degrees. In some embodiments, angle F is between about 55 to 65 degrees. In some embodiments, angle F is between about 65 to 75 degrees. In some embodiments, angle F is more than about 75 degrees.

When a piece of rebar 500 is positioned in between the steel pins, a user can rotate the rotator plate 140 via the handle 250, which causes the rebar 500 to bend. In some embodiments, a piece of rebar 500 is placed between the first steel pin 210 and the second steel pin 220 as well as between the first steel pin 210 and the third steel pin 230. In some embodiments, the piece of rebar 500 is placed between the first steel pin 210 and the second steel pin 220 as well as between the second steel pin 220 and the third steel pin 230.

A plurality of measurement markers 300 is disposed on the top surface 133 of the first measurement plate 130 and the second measurement plate 150. The measurement markers 300 allow the user to determine where the rebar 500 should be bent.

In some embodiments, the first steel pin 210 is equipped with a grease fitting 240 (e.g., a zerk fitting). Grease fittings are lubrication fittings used in mechanical systems to add grease. In some cases, grease fittings are installed by a threaded connection and have a nipple connection for connecting/attaching a grease gun. Grease can be added to the system (e.g., threaded connection) from the grease gun via the nipple connection. Grease fittings are well known to one of ordinary skill in the art. A grease fitting may be advantageous as it may make bending rebar easier and/or smoother.

The rebar bending device 100 of the present invention may be constructed from a variety of materials. For example, in some embodiments, the rebar bending device 100 may be constructed from a material comprising a metal (e.g., steel), a plastic, the like, or a combination thereof.

The rebar bending device 100 of the present invention may be constructed in a variety of sizes. For example, in some embodiments, the rebar bending device 100 is between about 20 to 30 inches in length, for example about 24 inches, as measured from the first end 131 of the first measurement plate to the second end 142 of the rotator plate 140.

In some embodiments, the base plate 120 and/or first measurement plate 130 and/or second measurement plate 150 and/or rotator plate 140 is between about 8 to 12 inches in length as measured from the first end to the second end. In some embodiments, the base plate 120 and/or first measurement plate 130 and/or second measurement plate 150 and/or rotator plate 140 is between about 12 to 16 inches in length as measured from the first end to the second end. In some embodiments, the base plate 120 and/or first measurement plate 130 and/or second measurement plate 150 and/or rotator plate 140 is between about 16 to 20 inches in length as measured from the first end to the second end. In some embodiments, the base plate 120 and/or first measurement plate 130 and/or second measurement plate 150 and/or rotator plate 140 is more than about 20 inches in length.

As used herein, the term "about" refers to plus or minus 10% of the referenced number. For example, an embodiment wherein the rebar bending device 100 is about 20 inches in length includes a rebar bending device 100 that is between 18 and 22 inches in length.

The following the disclosures of the following U.S. Patents are incorporated in their entirety by reference herein: U.S. Pat. No. 5,669,258; U.S. Pat. No. 6,993,950; U.S. Pat. No. 4,009,602; U.S. Pat. No. 3,943,747; U.S. Pat. No. 4,798,078.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A rebar bending device for allowing a user to bend a rebar, said rebar bending device comprising:

(a) a base plate having a top surface, a bottom surface, a first end, and a second end;

(b) a support beam attached to the bottom surface of the base plate, wherein the support beam is for allowing the rebar bending device to be mounted on a bed of a pickup truck, a tripod, a trailer hitch, or the like;

(c) a first measurement plate attached to the top surface of the base plate near the first end, wherein the first measurement plate has a top surface, a bottom surface, a first end, and a second end; wherein the first measurement plate is fixedly attached to the base plate;

(d) a rotator plate pivotally attached to the top surface of the base plate near the second end; wherein the rotator plate has a top surface, a bottom surface, a first end, and a second end;

(e) a first steel pin for pivotally connecting the rotator plate to the base plate, wherein the rotator plate can pivot about the first steel pin;

(f) a handle disposed on the second end of the rotator plate, wherein the handle allows the user to rotate the rotator plate about the first steel pin;

(g) a second measurement plate fixedly attached to the top surface of the first measurement plate near the second end of the first measurement plate and pivotally attached to the top surface of the rotator plate near the first end of the rotator plate via the first steel pin, wherein the second measurement plate has a top surface, a bottom surface, a first end, and a second end, wherein the first steel pin connects the second measurement plate to the rotator plate; wherein the rotator plate can pivot about the first steel pin between the base plate and the second measurement plate;

(h) a second steel pin disposed on the top surface of the second measurement plate near the first steel pin; and (i) a third steel pin disposed on the top surface of the rotator plate near the second end;

wherein the rebar can be positioned in between the first steel pin, the second steel pin, and the third steel pin; wherein a user can bend the rebar by rotating the rotator plate via the handle.

2. The rebar bending device of claim 1, wherein a plurality of measurement markers is disposed on the top surface of the first measurement plate, wherein the measurement markers allow the user to determine where the rebar should be bent.

3. The rebar bending device of claim 1, wherein a plurality of measurement markers is disposed on the top surface of the second measurement plate, wherein the measurement markers allow the user to determine where the rebar should be bent.

4. The rebar bending device of claim 1, wherein the first steel pin is equipped with a grease fitting.

5. The rebar bending device of claim 1, wherein a distance between the first steel pin and the second steel pin is about 1.75 inches, a distance between the second steel pin and the third steel pin is about 3 inches, and a distance between the first steel pin and the third steel pin is about 1.75 inches.

* * * * *